US010601143B2

(12) United States Patent
Tomura et al.

(10) Patent No.: US 10,601,143 B2
(45) Date of Patent: Mar. 24, 2020

(54) ANTENNA APPARATUS

(71) Applicant: Mitsubishi Electric Corporation, Tokyo (JP)

(72) Inventors: Takashi Tomura, Tokyo (JP); Michio Takikawa, Tokyo (JP); Yoshio Inasawa, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 16/069,093

(22) PCT Filed: Feb. 26, 2016

(86) PCT No.: PCT/JP2016/055877

§ 371 (c)(1),
(2) Date: Jul. 10, 2018

(87) PCT Pub. No.: WO2017/145379

PCT Pub. Date: Aug. 31, 2017

(65) Prior Publication Data

US 2019/0020118 A1 Jan. 17, 2019

(51) Int. Cl.
*H01Q 19/19* (2006.01)
*H01Q 25/00* (2006.01)
(Continued)

(52) U.S. Cl.
CPC ..... *H01Q 19/192* (2013.01); *H01Q 1/288* (2013.01); *H01Q 19/17* (2013.01); *H01Q 19/19* (2013.01); *H01Q 25/007* (2013.01)

(58) Field of Classification Search
CPC .... H01Q 19/192; H01Q 25/007; H01Q 19/17; H01Q 19/19
See application file for complete search history.

(56) References Cited

U.S. PATENT DOCUMENTS 4,855,751 A 8/1989 Ingerson
2005/0088356 A1* 4/2005 Lenormand ..... H01Q 3/2658 343/781 R
2014/0333498 A1* 11/2014 Romier ..... H01P 5/12 343/755

FOREIGN PATENT DOCUMENTS

EP 2 434 578 A1 3/2012
JP 2009-171308 A 7/2009
JP 4954099 B2 6/2012

OTHER PUBLICATIONS

Montero et al., "C-Band Multiple Beam Antennas for Communication Satellites", IEEE Transactions on Antennas and Propagation, Apr. 2015, vol. 63, No. 4, pp. 1263-1275, 0018-926X.
(Continued)

*Primary Examiner* — Dameon E Levi
*Assistant Examiner* — David E Lotter
(74) *Attorney, Agent, or Firm* — Birch, Stewart, Kolasch & Birch, LLP.

(57) ABSTRACT

A plurality of primary radiators (1) is classified by combinations of frequency and polarization of radiated radio waves, a plurality of primary radiators (1) belonging to the same class is arranged at positions corresponding to vertexes of one of triangles in a repeated triangle pattern $TR_{Pattern}$, and the shape of a main reflector (2) and the shape and arrangement of the repeated triangle pattern $TR_{Pattern}$ are determined such that a direction of a line segment passing through positions corresponding to two vertexes in the triangle is different from a radiation direction of a sidelobe of a radio wave reflected by a main reflector (2) after having been radiated from a primary radiator (1) arranged at a position corresponding to the vertexes.

6 Claims, 9 Drawing Sheets

(51) Int. Cl.
*H01Q 1/28* (2006.01)
*H01Q 19/17* (2006.01)

(56) References Cited

OTHER PUBLICATIONS

Extended European Search Report dated Jan. 7, 2019 in corresponding European Patent Application No. 16891536.1.
Sudhakar Rao K. et al. "Developemtn of a 45 GHZ Multiple-Beam Antenna for Military Satellite Communications", IEEE Transactions on Computers, IEEE, USA, vol. 43, No. 10, Oct. 1, 1995 pp. 1036-1046.
Office Action dated Sep. 4, 2019 issued in corresponding European Patent Application No. 16891536.1.

* cited by examiner

FIG. 3
| Label | Polarization | Frequency |
|---|---|---|
| A | P1 | F1 |
| B | P2 | F1 |
| C | P1 | F2 |
| D | P2 | F2 |
FIG. 4A
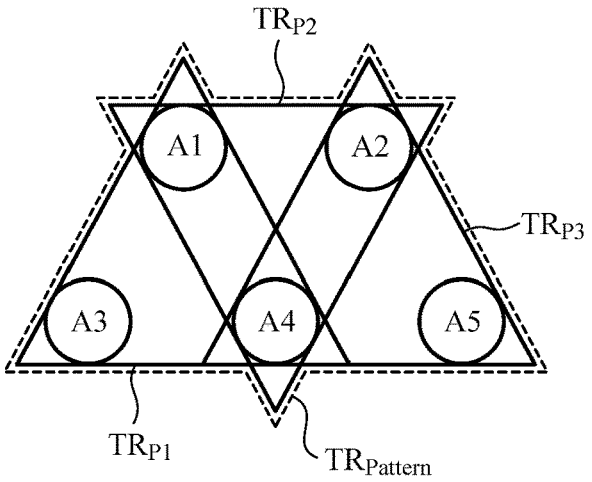
FIG. 4B
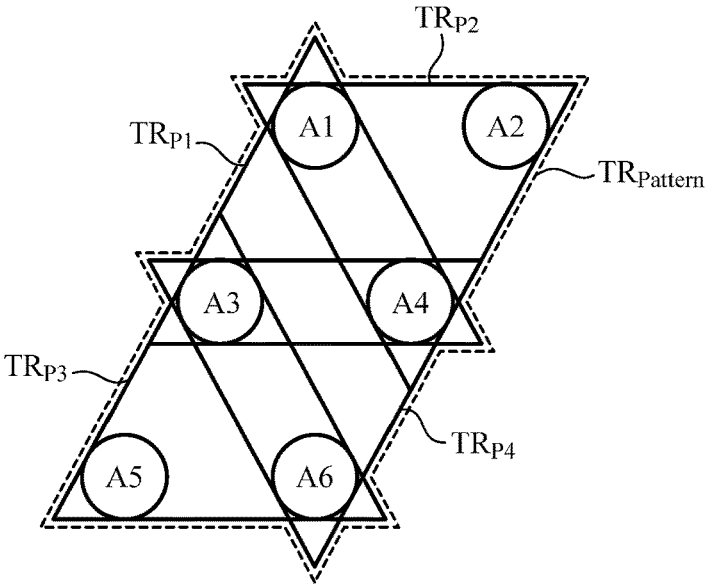

FIG. 9
| Beam | Parallelogram | Circle |
|---|---|---|
| C1 | −28.5 | −23.2 |
FIG. 10
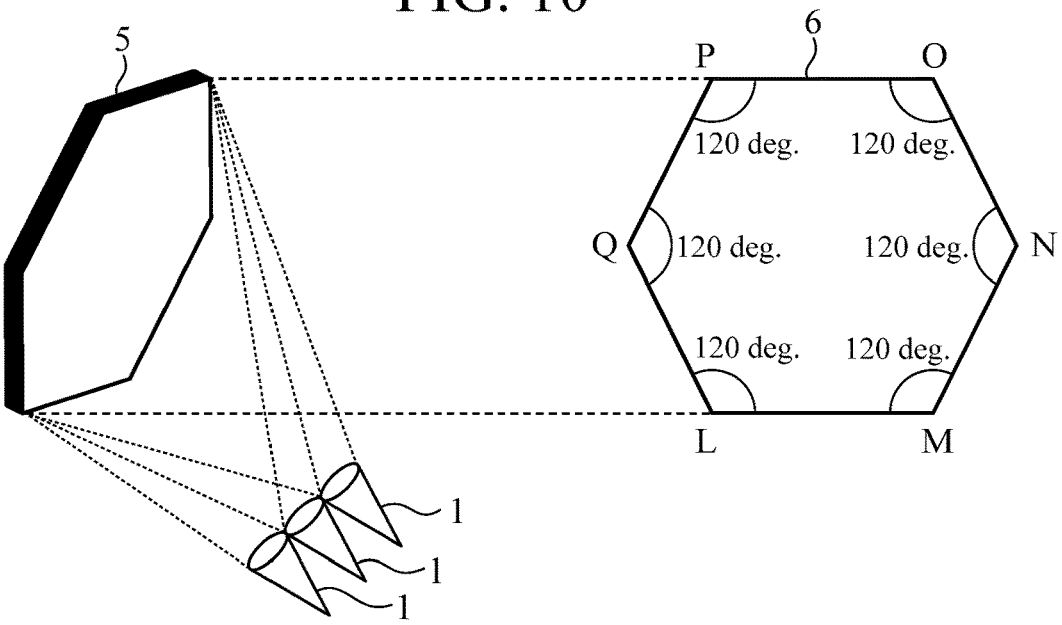
FIG. 11
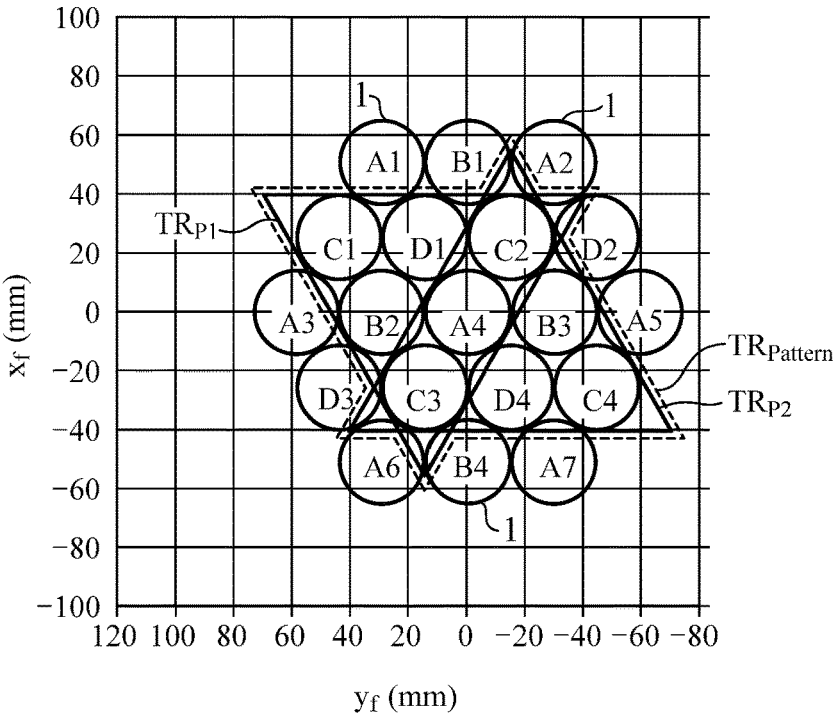

ANTENNA APPARATUS

TECHNICAL FIELD

The present disclosure relates to antenna apparatuses for forming multiple beams.

BACKGROUND ART

In recent years, research and development of satellite communication technology using antenna apparatus have been under way. In order to achieve high-speed communications, it is necessary to use an antenna apparatus with high gain and low interference.

To achieve high gain, antenna apparatuses of a system in which a service area is covered with a plurality of spot beams have been studied. In the system of covering a service area with a plurality of spot beams, it is possible to achieve higher gain than in the case of a general contoured beam antenna.

As to interference, which is generally evaluated by carrier-to-interference ratio (C/I), adjacent beams typically use different frequencies or polarizations to achieve low interference. That is, multiple combinations of frequency and polarization are prepared such that adjacent beams do not use the same combination of frequency and polarization.

As a result, interference between adjacent beams can be suppressed. However, interference may occur between beams using the same combination of frequency and polarization.

In an antenna apparatus disclosed in the following Patent Literature 1, interference waves are reduced by using multiple antenna elements to form one beam and using different excitation coefficients for the multiple antenna elements.

CITATION LIST

Patent Literature

Patent Literature 1: JP 2009-171308 A

SUMMARY OF INVENTION

Technical Problem

Since the conventional antenna apparatus are configured as described above, there is a problem that, even though interference can be suppressed between desired two beams out of a plurality of beams having the same combination of frequency and polarization can be suppressed, it is difficult to suppress interference among all the beams having the same combination of frequency and polarization.

Embodiments of the present disclosure have been devised in order to solve the problem as described above, and it is an object of the present disclosure to provide an antenna apparatus capable of suppressing interference among all the beams having the same combination of frequency and polarization.

Solution to Problem

An antenna apparatus according to the present disclosure includes: a plurality of primary radiators for radiating radio waves; and a main reflector for reflecting the radio waves radiated from the plurality of primary radiators, wherein the plurality of primary radiators is classified by combination of frequency and polarization of the radiated radio waves, a plurality of primary radiators belonging to a same class is arranged, in a repeated triangle pattern in which a triangle is arranged repeatedly, at positions corresponding to vertexes of each triangle, and a shape of the main reflector and a shape and arrangement of the repeated triangle pattern are determined such that a direction of a line segment passing through positions corresponding to two vertexes in the triangle is different from a radiation direction of a sidelobe of a radio wave that is radiated from primary radiators arranged at positions corresponding to the vertexes and is reflected by the main reflector.

Advantageous Effects of Invention

According to the present disclosure, a plurality of primary radiators is classified by combination of frequency and polarization of the radiated radio waves, a plurality of primary radiators belonging to the same class is arranged at positions corresponding to vertexes of one of triangles in a repeated triangle pattern in which a triangular shape is repeated, and a shape of the main reflector and a shape and arrangement of the repeated triangle pattern are determined such that a direction of a line segment passing through positions corresponding to two vertexes in the triangle is different from a radiation direction of a sidelobe of a radio wave reflected by the main reflector after having been radiated from a primary radiator arranged at a position corresponding to the vertexes. Therefore, the effect of suppressing interference among all the beams having the same combination of frequency and polarization can be obtained.

BRIEF DESCRIPTION OF DRAWINGS

FIG. 3 is an explanatory diagram illustrating an example of combinations of frequency and polarization corresponding to labels.

FIG. 4A is an explanatory diagram illustrating a repeated triangle pattern $TR_{Pattern}$ in which three triangular shapes $TR_{P1}$, $TR_{P2}$, and $TR_{P3}$ are arranged in the horizontal direction, FIG. 4B is an explanatory diagram illustrating a repeated triangle pattern $TR_{Pattern}$ in which the two triangular shapes $TR_{p1}$ and $TR_{P3}$ are arranged in the horizontal direction and two triangular shapes $TR_{P3}$ and $TR_{P4}$ are arranged in the horizontal direction while the two triangular shapes $TR_{P1}$ and $TR_{P3}$ are arranged in the vertical direction and two triangular shape patterns $TR_{P2}$ and $TR_{P4}$ are arranged in the vertical direction.

FIG. 9 is an explanatory diagram showing C/I values in the case where the aperture shape of the main reflector 2 is a parallelogram and in the case where it is circular.

FIG. 10 is a configuration diagram illustrating an antenna apparatus according to Second Embodiment of the present disclosure.

FIG. 11 is a diagram showing an illustrative example of arrangement of primary radiators 1 of the antenna apparatus according to Second Embodiment of the present disclosure.

DESCRIPTION OF EMBODIMENTS

To describe the present disclosure further in detail, embodiments of the present disclosure will be described below with reference to the accompanying drawings.

First Embodiment

Figure 1:
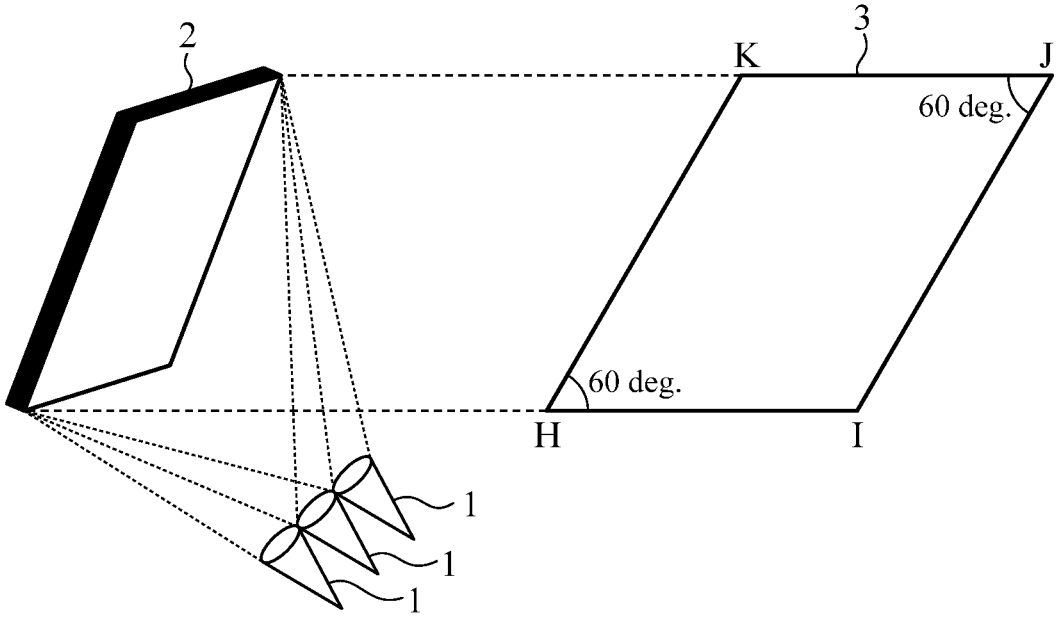
FIG. 1 is a configuration diagram illustrating an antenna apparatus according to First Embodiment of the present disclosure.

FIG. 1 is a configuration diagram illustrating an antenna apparatus according to First Embodiment of the present disclosure.

In FIG. 1, each of primary radiators 1 is a radio wave irradiation source for radiating a radio wave toward a main reflector 2.

The primary radiators 1 are arranged such that a spillover of the main reflector 2 is reduced and, in the example of FIG. 1, are arranged near a focal point of the main reflector 2.

The main reflector 2 reflects radio waves radiated from the plurality of primary radiators 1, and in the example of FIG. 1 the shape of the main reflector 2 is a parabolid.

Reference numeral 3 illustrates an aperture shape when the main reflector 2 is viewed from the front, and in the example of FIG. 1 an aperture shape 3 of the main reflector 2 is a parallelogram.

In First Embodiment, the plurality of primary radiators 1 are classified according to combination of frequency and polarization of radiated radio waves, and a plurality of primary radiators 1 belonging to the same class are arranged at positions corresponding to vertexes of triangles in a repeated triangle pattern in which a triangular shape is repeatedly arranged. Details will be described later.

Furthermore, the shape of the main reflector 2 and the shape and arrangement of the repeated triangle pattern are determined such that a direction of a line segment passing through positions corresponding to two vertexes in a triangle is different from a radiation direction of a sidelobe of a radio wave that is radiated from primary radiators 1 arranged at positions corresponding to the vertexes and is reflected by the main reflector 2.

Figure 2:
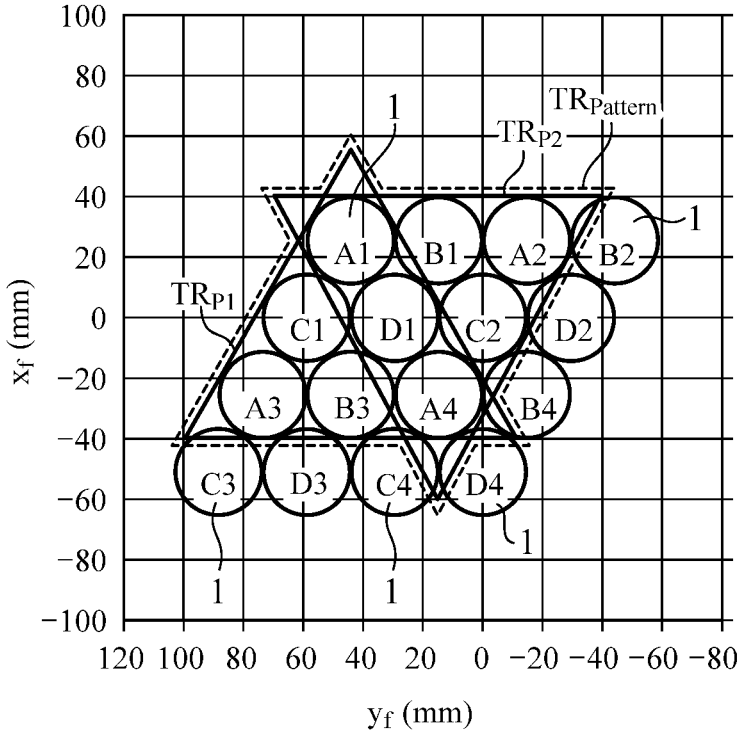
FIG. 2 is a diagram showing an illustrative example of arrangement of primary radiators 1 of the antenna apparatus according to First Embodiment of the present disclosure.

FIG. 2 is a diagram showing an illustrative example of arrangement of the primary radiators 1 of the antenna apparatus according to First Embodiment of the present disclosure.

FIG. 2 illustrates arrangement of the primary radiators 1 as viewed from the front, and in the example of FIG. 2 sixteen primary radiators 1 are arranged. However, this is merely an example, and the number is not limited to sixteen.

An alphabet in the figure is a label representing a combination of frequency and polarization of a radio wave radiated from a primary radiator 1, and primary radiators 1 labeled with the same alphabet use the same combination of frequency and polarization.

FIG. 3 is an explanatory diagram illustrating an example of combinations of frequency and polarization corresponding to labels.

In FIG. 3, for example, combinations of two types of polarizations P1 and P2 such as vertical polarization and horizontal polarization and two types of frequencies F1 and F2 are illustrated, and in FIG. 3 a total of four combinations are described as an example.

The sixteen primary radiators 1 in FIG. 2 are classified according to combination of frequency and polarization of radiated radio waves, and primary radiators 1 labeled A1, A2, A3, and A4 belong to the same class, and primary radiators 1 labeled B1, B2, B3, and B4 belong to the same class.

Primary radiators 1 labeled C1, C2, C3, and C4 belong to the same class, and primary radiators 1 labeled D1, D2, D3, and D4 belong to the same class.

A plurality of primary radiators 1 belonging to the same class is arranged at positions corresponding to vertexes of triangles in a repeated triangle pattern in which one or more triangular shapes are repeated.

Looking at the four primary radiators 1 labeled A1, A2, A3, and A4 for example, the three primary radiators 1 labeled A1, A3, and A4 are arranged in a triangular shape, and the three primary radiators 1 labeled A1, A2, and A4 are also arranged in a triangular shape.

That is, the four primary radiators 1 labeled A1, A2, A3, and A4 are arranged at positions corresponding to vertexes of triangles in a repeated triangle pattern $TR_{Pattern}$ in which a triangular shape $TR_{P1}$ and a triangular shape $TR_{P2}$ are arranged.

The triangular shape $TR_{P1}$ is an arrangement of the three primary radiators 1 labeled A1, A3, and A4, and the triangular shape $TR_{P2}$ is an arrangement of the three primary radiators 1 labeled A1, A2, and A4. FIG. 2 illustrates an example in which each of the triangles is an equilateral triangle.

In FIG. 2, an example of the repeated triangle pattern $TR_{Pattern}$ in which the two triangular shapes $TR_{P1}$ and $TR_{P2}$ are arranged in the horizontal direction in the figure is illustrated; however, a repeated triangle pattern $TR_{Pattern}$ in which three or more triangular shapes $TR_P$ are arranged in the horizontal direction or a repeated triangle pattern $TR_{Pattern}$ in which a plurality of triangular shapes $TR_P$ are arranged in the vertical direction may be employed.

As shown in the example of FIG. 2, the four primary radiators 1 labeled A1, A2, A3, and A4 are arranged so as to be in contact with sides of the triangles, and thus the position of the center of each of the primary radiators 1 is apart from the position of a vertex of the triangles. Because the four primary radiators 1 are arranged near the vertexes of the triangles, the four primary radiators 1 are arranged at positions corresponding to the vertexes of the triangles.

Note that it is understood without saying that the position of the center of each of the primary radiators 1 may be arranged so as to coincide with a vertex of the triangles.

FIG. 4 includes explanatory diagrams illustrating examples of a repeated triangle pattern $TR_{Pattern}$.

FIG. 4A is a diagram illustrating a repeated triangle pattern $TR_{Pattern}$ in which three triangular shapes $TR_{P1}$, $TR_{P2}$, and $TR_{P3}$ are arranged in the horizontal direction.

The triangular shape $TR_{P1}$ is an arrangement of the three primary radiators 1 labeled A1, A3, and A4, the triangular shape $TR_{P2}$ is an arrangement of the three primary radiators 1 labeled A1, A2, and A4, and the triangular shape $TR_{P3}$ is an arrangement of the three primary radiators 1 labeled A2, A4, and A5.

FIG. 4B is a diagram illustrating a repeated triangle pattern $TR_{Pattern}$ in which the two triangular shapes $TR_{P1}$ and $TR_{P2}$ are arranged in the horizontal direction and the two triangular shapes $TR_{P3}$ and $TR_{P4}$ are arranged in the horizontal direction, while the two triangular shapes $TR_{P1}$ and $TR_{P2}$ are arranged in the vertical direction and two triangular shapes $TR_{P2}$ and $TR_{P4}$ are arranged in the vertical direction.

The triangular shape $TR_{P1}$ is an arrangement of the three primary radiators 1 labeled A1, A3, and A4, the triangular shape $TR_{P2}$ is an arrangement of the three primary radiators 1 labeled A1, A2, and A4, the triangular shape $TR_{P3}$ is an arrangement of the three primary radiators 1 labeled A3, A5, and A6, and the triangular shape $TR_{P4}$ is an arrangement of the three primary radiators 1 labeled A3, A4, and A6.

As can be seen from FIG. 4, a repeated triangle pattern $TR_{Pattern}$ of a desired shape can be created by repeating a plurality of triangular shapes $TR_P$ in a desired direction.

In the above, the repeated triangle pattern $TR_{Pattern}$ in which one or more triangular shapes are repeated has been described focusing on the four primary radiators 1 labeled A1, A2, A3, and A4. In the example of FIG. 2, arrangements of the primary radiators 1 labeled B1, B2, B3, and B4 also form a repeated triangle pattern $TR_{Pattern}$ in which the two triangular shapes $TR_P$ are arranged in the horizontal direction.

Likewise, arrangements of the primary radiators 1 labeled C1, C2, C3, and C4 also form a repeated triangle pattern $TR_{Pattern}$ in which two triangular shapes $TR_P$ are arranged in the horizontal direction, and arrangements of the primary radiators 1 labeled D1, D2, D3, and D4 also form a repeated triangle pattern $TR_{Pattern}$ in which two triangular shapes $TR_P$ are arranged in the horizontal direction.

In the example of FIG. 2, since there are four combinations of frequency and polarization of radiated radio waves, four repeated triangle patterns $TR_{Pattern}$ each corresponding to one of the combinations are arranged to be combined regularly, and the overall arrangement shape of the sixteen primary radiators 1 has the same parallelogram shape as that of the aperture shape 3 of the main reflector 2.

Furthermore in the example of FIG. 2, given vertexes H, I, J, and K of the parallelogram which is the aperture shape 3 of the main reflector 2, interior angles ∠IHK and ∠IJK of the parallelogram have 60 degrees, which are equal to an interior angle of an equilateral triangle. Moreover, the sixteen primary radiators 1 are arranged such that a radio wave radiated from the primary radiator 1 labeled C3 is irradiated near the vertex H, a radio wave radiated from the primary radiator 1 labeled D4 is irradiated near the vertex I, a radio wave radiated from the primary radiator 1 labeled B2 is irradiated near the vertex J, and a radio wave radiated from the primary radiator 1 labeled A1 is irradiated near the vertex K.

Also, focusing on the three primary radiators 1 labeled A1, B1, and D1 out of the sixteen primary radiators 1, the three primary radiators 1 are arranged in an equilateral triangle shape without overlapping. This is to arrange beams densely, and the equilateral triangle shape is known as a shape that enables the densest arrangement of a circular aperture.

Next, operations will be described.

The sixteen primary radiators 1 radiate radio waves toward the main reflector 2. Each of the radio waves radiated from the primary radiators 1 is hereinafter referred to as a beam.

The main reflector 2 reflects beams radiated from the sixteen primary radiators 1.

Figure 5:
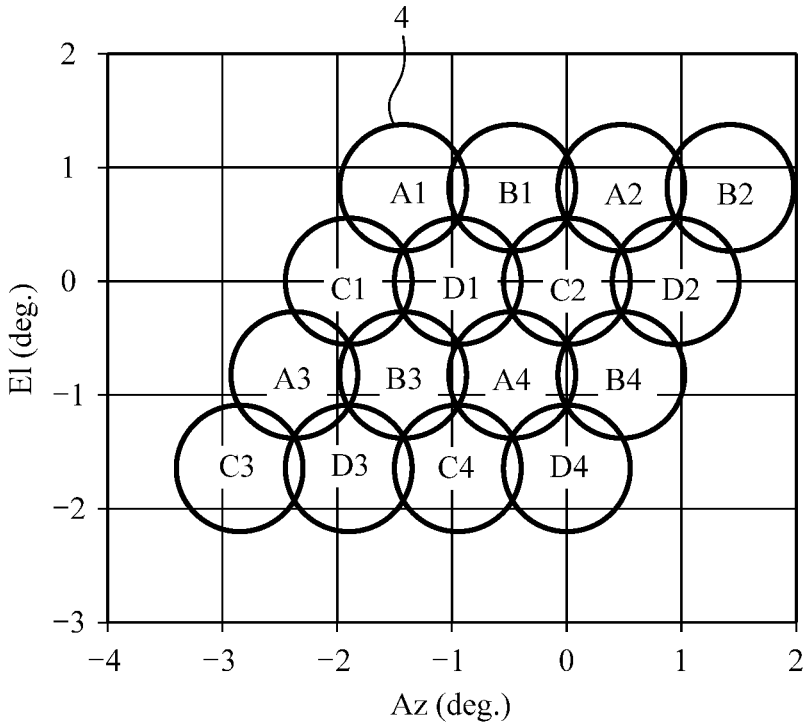
FIG. 5 is an explanatory diagram illustrating radiation direction 4 of beams reflected by a main reflector 2.

FIG. 5 is an explanatory diagram illustrating radiation directions 4 of the beams reflected by the main reflector 2.

In FIG. 5, the horizontal axis represents the angle in a horizontal plane, the vertical axis represents the angle in a vertical plane, and a radiation direction 4 of a beam corresponds to a service area of a radio wave.

Furthermore, a label attached to each of the radiation directions 4 of the beams corresponds to a label labeled to each of the primary radiators 1 illustrated in FIG. 2.

FIG. 6 includes explanatory diagrams illustrating radiation directions $\theta_1$ and $\theta_2$ of sidelobes of a reflection beam of a primary radiator 1.

Hereinafter, the expression "reflection beam of a primary radiator 1" means a beam radiated from the primary radiator 1 and then reflected by the main reflector 2.

Figure 6A:
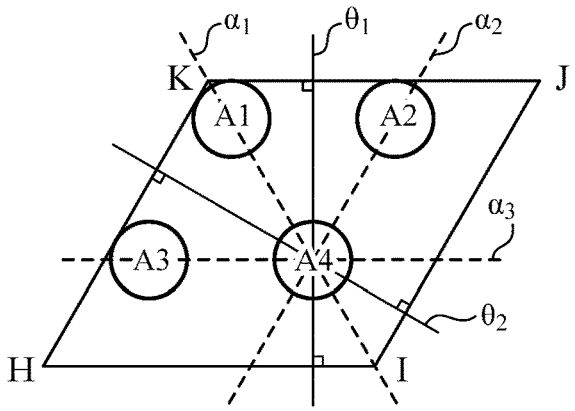
FIG. 6A is an explanatory diagram illustrating radiation directions $\theta_1$ and $\theta_2$ of sidelobes of a reflected beam of a primary radiator 1 labeled A4.
Figure 6B:
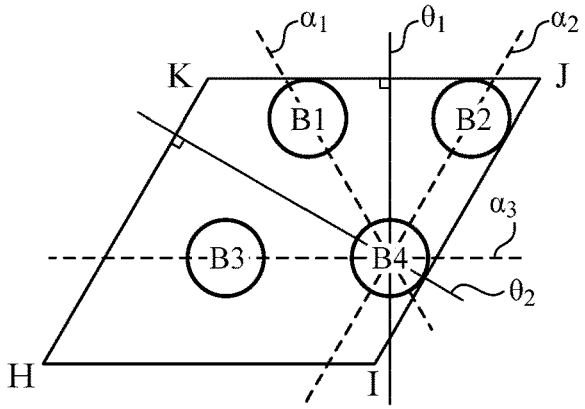
FIG. 6B is an explanatory diagram illustrating radiation directions $\theta_1$ and $\theta_2$ of sidelobes of a reflected beam of a primary radiator 1 labeled B4.

FIG. 6A is an explanatory diagram illustrating radiation directions $\theta_1$ and $\theta_2$ of sidelobes of a reflection beam of the primary radiator 1 labeled A4, and FIG. 6B is an explanatory diagram illustrating radiation directions $\theta_1$ and $\theta_2$ of sidelobes of a reflection beam of the primary radiator 1 labeled B4.

Figure 6C:
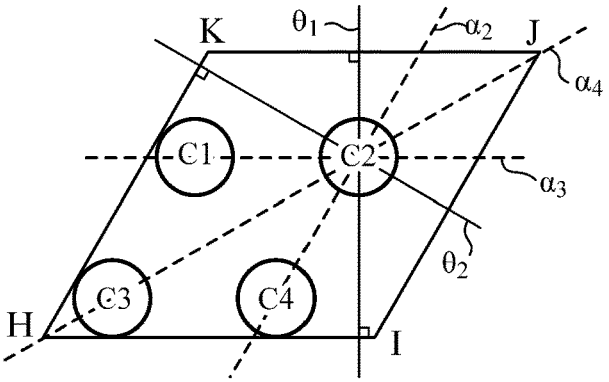
FIG. 6C is an explanatory diagram illustrating radiation directions $\theta_1$ and $\theta_2$ of sidelobes of a reflected beam of a primary radiator 1 labeled C2.
Figure 6D:
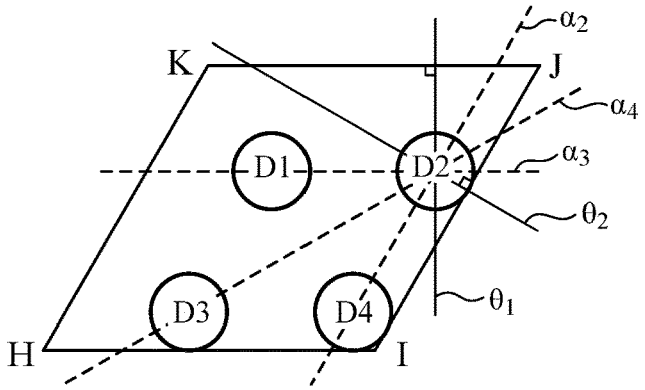
FIG. 6D is an explanatory diagram illustrating radiation directions $\theta_1$ and $\theta_2$ of sidelobes of a reflected beam of a primary radiator 1 labeled D2.

Furthermore, FIG. 6C is an explanatory diagram illustrating radiation directions $\theta_1$ and $\theta_2$ of sidelobes of a reflection beam of the primary radiator 1 labeled C2, and FIG. 6D is an explanatory diagram illustrating radiation directions $\theta_1$ and $\theta_2$ of sidelobes of a reflection beam of the primary radiator 1 labeled D2.

The radiation directions $\theta_1$ and $\theta_2$ of sidelobes are determined by the aperture shape 3 of the main reflector 2, and in a case where the aperture shape 3 of the main reflector 2 is a parallelogram, each of the radiation directions $\theta_1$ and $\theta_2$ is formed in the direction that is perpendicular to associated opposing two sides of the parallelogram.

Looking at the primary radiator 1 labeled A4 for example, as illustrated in FIG. 6A, sidelobes are formed in a direction $\theta_1$ perpendicular to a line segment HI and a line segment KJ of the parallelogram, while other sidelobes are formed in a direction $\theta_2$ perpendicular to a line segment HK and a line segment IJ of the parallelogram.

Further looking at the primary radiator 1 labeled B4, as illustrated in FIG. 6B, sidelobes are formed in a direction $\theta_1$ perpendicular to the line segment HI and the line segment KJ of the parallelogram, while other sidelobes are formed in a direction $\theta_2$ perpendicular to the line segment HK and the line segment IJ of the parallelogram.

Looking at the primary radiator 1 labeled C2, as illustrated in FIG. 6C, sidelobes are formed in a direction $\theta_1$ perpendicular to the line segment HI and the line segment KJ of the parallelogram, while other sidelobes are formed in a direction $\theta_2$ perpendicular to the line segment HK and the line segment IJ of the parallelogram.

Further looking at the primary radiator 1 labeled D2, as illustrated in FIG. 6D, sidelobes are formed in a direction $\theta_1$ perpendicular to the line segment HI and the line segment KJ of the parallelogram, while other sidelobes are formed in a direction $\theta_2$ perpendicular to the line segment HK and the line segment IJ of the parallelogram.

Looking at the primary radiator 1 labeled A4 for example, primary radiators 1 having the same combination of frequency and polarization as that of a beam of the primary radiator 1 labeled A4 are the primary radiators 1 labeled A1, A2, and A3.

Therefore, out of beams reflected by the main reflector 2, reflection beams of the primary radiators 1 labeled A1, A2, and A3 may be interfered by a reflection beam of the primary radiator 1 labeled A4.

However, in First Embodiment, since the overall arrangement of the sixteen primary radiators 1 has the same parallelogram shape as that of the aperture shape 3 of the main reflector 2, the reflection beams of the primary radiators 1 labeled A1, A2, and A3 are not interfered by the reflection beam of the primary radiator 1 labeled A4.

That is, the primary radiator 1 labeled A4 is arranged at a position corresponding to a vertex of the same equilateral triangle as that of the primary radiators 1 labeled A1 and A2. Furthermore, the primary radiator 1 labeled A4 is arranged at a position corresponding to a vertex of the same equilateral triangle as that of the primary radiators 1 labeled A1 and A3.

Suppose the position that corresponds to the vertex of the equilateral triangle(s) at which the primary radiator 1 labeled A4 is arranged is a base point. Then, directions of line segments passing through the base point and the positions corresponding to the other vertexes of the equilateral triangles are given as a direction $\alpha_1$, a direction $\alpha_2$, and a direction $\alpha_3$ as illustrated in FIG. 6A.

Specifically, a direction of a line segment passing through the arrangement position of the primary radiator 1 labeled A4 and the arrangement position of the primary radiator 1 labeled A1 is $\alpha_1$, and a direction of a line segment passing through the arrangement position of the primary radiator 1 labeled A4 and the arrangement position of the primary radiator 1 labeled A2 is $\alpha_2$. Moreover, a direction of a line segment passing through the arrangement position of the primary radiator 1 labeled A4 and the arrangement position of the primary radiator 1 labeled A3 is $\alpha_3$.

Because the directions $\alpha_1$, $\alpha_2$, and $\alpha_3$ of the line segments are different from the radiation directions $\theta_1$ and $\theta_2$ of the sidelobes, reflection beams of the primary radiators 1 labeled A1, A2, and A3 are not interfered by the reflection beam of the primary radiator 1 labeled A4.

Looking at the primary radiator 1 labeled C2 for example, primary radiators 1 having the same combination of frequency and polarization as that of a beam of the primary radiator 1 labeled C2 are the primary radiators 1 labeled C1, C3, and C4.

Therefore, out of beams reflected by the main reflector 2, reflection beams of the primary radiators 1 labeled C1, C3, and C4 may be interfered by a reflection beam of the primary radiator 1 labeled C2.

However, in First Embodiment, since the overall arrangement of the sixteen primary radiators 1 has the same parallelogram shape as that of the aperture shape 3 of the main reflector 2, the reflection beams of the primary radiators 1 labeled C1, C3, and C4 are not interfered by the reflection beam of the primary radiator 1 labeled C2.

That is, the primary radiator 1 labeled C2 is arranged at a position corresponding to a vertex of the same equilateral triangle as that of the primary radiators 1 labeled C1 and C4.

Suppose the position that corresponds to the vertex of the equilateral triangle at which the primary radiator 1 labeled C2 is arranged is a base point. Then, directions of line segments passing through the base point and the positions corresponding to the other vertexes of the equilateral triangle are given as a direction $\alpha_3$ and a direction $\alpha_2$ as illustrated in FIG. 6C.

Specifically, a direction of a line segment passing through the arrangement position of the primary radiator 1 labeled C2 and the arrangement position of the primary radiator 1 labeled C1 is $\alpha_3$, and a direction of a line segment passing through the arrangement position of the primary radiator 1 labeled C2 and the arrangement position of the primary radiator 1 labeled C4 is $\alpha_2$.

Although the primary radiator 1 with label C2 and the primary radiator 1 labeled C3 are not located at positions corresponding to vertexes of the same equilateral triangle, a direction of a line segment passing through the arrangement position of the primary radiator 1 labeled C2 and the arrangement position of the primary radiator 1 labeled C3 is $\alpha_4$.

Because the directions $\alpha_2$, $\alpha_3$, and $\alpha_4$ of the line segments are different from the radiation directions $\theta_1$ and $\theta_2$ of the sidelobes, reflection beams of the primary radiators 1 labeled C1, C3, and C4 are not interfered by the reflection beam of the primary radiator 1 labeled C2.

Looking at the primary radiator 1 labeled B4, a similar relation to the case of looking at the primary radiator 1 labeled A4 applies, and reflection beams of the primary radiators 1 labeled B1, B2, and B3 are not interfered by a reflection beam of the primary radiator 1 labeled B4.

In addition, looking at the primary radiator 1 labeled D2, a similar relation to the case of looking at the primary radiator 1 labeled C2 applies, and reflection beams of the primary radiators 1 labeled D1, D3, and D4 are not interfered by a reflection beam of the primary radiator 1 labeled D2.

Figure 7:
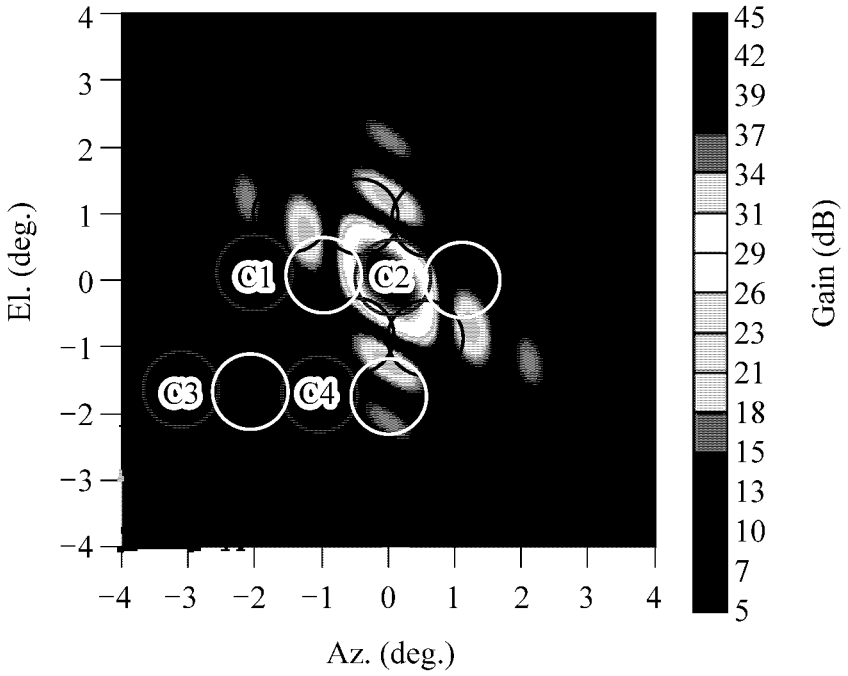
FIG. 7 is an explanatory diagram illustrating a simulation result of a radiation pattern of a reflection beam of the primary radiator 1 labeled C2.

FIG. 7 is an explanatory diagram illustrating a simulation result of a radiation pattern of a reflection beam of the primary radiator 1 labeled C2.

In FIG. 7, the horizontal axis represents the angle in a horizontal plane, and the vertical axis represents the angle in a vertical plane. Since the aperture shape 3 of the main reflector 2 is a parallelogram, sidelobes due to the reflection beam of the primary radiator 1 labeled C2 are formed in two directions.

However, as described above, it is understood that the reflection beams of the primary radiators 1 labeled C1, C3, and C4 are not interfered by the reflection beam of the primary radiator 1 labeled C2 since the directions $\alpha_2$, $\alpha_3$, and $\alpha_4$ of the line segments are different from the radiation directions $\theta_1$ and $\theta_2$ of the sidelobes.

Figure 8:
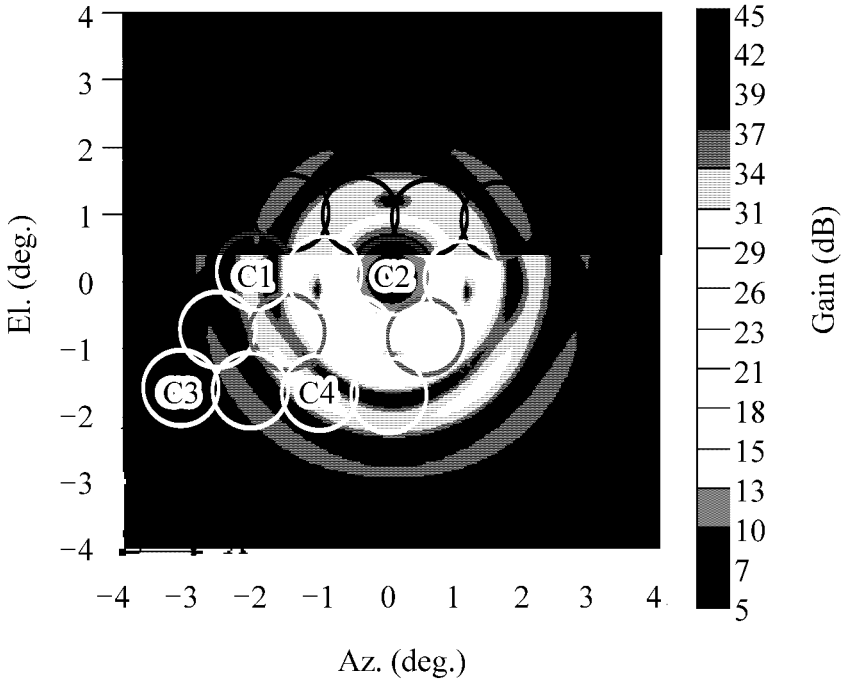
FIG. 8 is an explanatory diagram illustrating a simulation result of a radiation pattern of the reflection beam of the primary radiator 1 labeled C2 in the case where an aperture shape of the main reflector 2 is circular.

FIG. 8 is an explanatory diagram illustrating a simulation result of a radiation pattern of the reflection beam of the primary radiator 1 labeled C2 in the case where the aperture shape of the main reflector 2 is circular.

In FIG. 8, the horizontal axis represents the angle in a horizontal plane, and the vertical axis represents the angle in a vertical plane.

In the case where the aperture shape of the main reflector 2 is circular, sidelobes due to the reflection beam of the primary radiator 1 labeled C2 are concentrically formed around the direction of the main beam. It can be understood that as a result of the above the sidelobes due to the reflection beam of the primary radiator 1 labeled C2 arrive at service areas of reflection beams of the primary radiators 1 labeled C1, C3, and C4, and thus the reflection beams of the primary radiators 1 labeled C1, C3, and C4 are interfered by the reflection beam of the primary radiator 1 labeled C2.

Note that, in the case where the aperture shape of the main reflector 2 is rectangular, sidelobes are formed in directions each perpendicular to two opposing sides of the rectangle. Therefore, the reflection beams of the primary radiators 1 labeled C3 and C4 are not interfered by the reflection beam of the primary radiator 1 labeled C2; however, the reflection beam of the primary radiator 1 labeled C1 is interfered by the reflection beam of the primary radiator 1 labeled C2 since the sidelobes due to the reflection beam of the primary radiator 1 labeled C2 arrive at the service area of the reflection beam of the primary radiator 1 labeled C1.

FIG. 9 is an explanatory diagram showing C/I values in the case where the aperture shape of the main reflector 2 is a parallelogram and in the case where it is circular.

A C/I in the case where the aperture shape 3 of the main reflector 2 is a parallelogram is −28.5 dB, and a C1 in the case where the aperture shape of the main reflector is circular is −23.2 dB, and therefore the C/I is improved by 5.3 dB in the case where the aperture shape 3 of the main reflector 2 is a parallelogram than in the case where the aperture shape is circular.

As is apparent from the above, according to First Embodiment, the plurality of primary radiators 1 is classified by combination of frequency and polarization of the radiated radio waves, a plurality of primary radiators belonging to the same class is arranged at positions corresponding to vertexes of one of triangles in a repeated triangle pattern $TR_{Pattern}$, and the shape of the main reflector 2 and the shape and arrangement of the repeated triangle pattern $TR_{Pattern}$ are determined such that a direction of a line segment passing through positions corresponding to two vertexes in the triangle is different from a radiation direction of a sidelobe of a radio wave reflected by the main reflector 2 after having been radiated from a primary radiator 1 arranged at a position corresponding to the vertexes. Therefore, the effect of suppressing interference among all the beams having the same combination of frequency and polarization can be obtained.

According to First Embodiment, the aperture shape 3 of the main reflector 2 is a parallelogram, and one or more triangular shapes are repeated such that the repeated triangle pattern $TR_{Pattern}$ has the same shape as that of the aperture shape 3 of the main reflector 2, and thus a major part of radio waves radiated from the plurality of primary radiators 1 is reflected by the main reflector 2, thereby enabling mitigation of radio waves not reflected by the main reflector 2. Therefore, the utilization rate of radio waves is increased, and the gain of the antenna apparatus can be increased.

In First Embodiment, the example has been illustrated in which two interior angles of the parallelogram which is the aperture shape 3 of the main reflector 2, that is, the ∠IHK and the ∠IJK are 60 degrees, which are equal to the interior angles of an equilateral triangle; however, even in the case where the ∠IHK and the ∠IJK of the parallelogram deviate from 60 degrees by about 20%, interference among all the beams having the same combination of frequency and polarization can be suppressed. That is, even in the case where the aperture shape 3 of the main reflector 2 is not a perfect parallelogram, interference among all the beams having the same combination of frequency and polarization can be suppressed.

In First Embodiment, the example in which the three primary radiators 1 are arranged in a triangular shape has been illustrated; however depending on a required service area, one or two primary radiators 1 may be thinned out from those in a triangular shape $TR_P$ from among a plurality of triangular shapes $TR_P$.

Furthermore, it is only required that an arrangement of the repeated triangle pattern $TR_{Pattern}$ is in conformity with the arrangement of FIG. 2 for example, and the shape of the repeated triangle pattern $TR_{Pattern}$ is not required to be a parallelogram as a result of thinning out some of the primary radiators 1.

In First Embodiment, the example in which there are four combinations of frequency and polarization has been illustrated; however, this is merely an example, and the number of combinations of frequency and polarization may be three or seven, for example.

In First Embodiment, the aperture shape 3 of the main reflector 2 is a parallelogram; however, vertexes of the parallelogram are not required to be angular and may be, for example, rounded or chamfered.

Second Embodiment

In Embodiment 1, the aperture shape 3 of the main reflector 2 is a parallelogram. In Second Embodiment, an example in which an aperture shape of the main reflector is a hexagon will be described.

In the case where the aperture shape 3 of the main reflector 2 is a parallelogram, for example when the antenna apparatus is mounted on a satellite, useless space is created, and the space cannot be effectively used, which may deteriorate mountability to the satellite.

Accordingly, in Second Embodiment, an example will be described in which a hexagon is used as a shape that enables more effective use of the space.

FIG. 10 is a configuration diagram illustrating an antenna apparatus according to Second Embodiment of the present disclosure. In FIG. 10, the same reference numeral as that in FIG. 1 represents the same or a corresponding part and thus descriptions thereon are omitted.

A main reflector 5 is a reflector which reflects radio waves radiated from a plurality of primary radiators 1.

Reference numeral 6 denotes an aperture shape of the main reflector 5 when viewed from the front, and in the example of FIG. 10, an aperture shape 6 of the main reflector 5 is a hexagon.

In Second Embodiment, it is assumed that the aperture shape 6 of the main reflector 5 is a regular hexagon.

FIG. 11 is a diagram showing an illustrative example of arrangement of the primary radiators 1 of the antenna apparatus according to Second Embodiment of the present disclosure.

FIG. 11 illustrates an arrangement of the primary radiators 1 as viewed from the front, and in the example of FIG. 11 nineteen primary radiators 1 are arranged. However, this is merely an example, and the number is not limited to nineteen.

An alphabet in the figure is a label representing a combination of frequency and polarization of a radio wave radiated from a primary radiator 1, and primary radiators 1 labeled with the same alphabet use the same combination of frequency and polarization.

The nineteen primary radiators 1 in FIG. 11 are classified by combinations of frequency and polarization of radiated radio waves, and primary radiators 1 labeled A1, A2, A3, A4, A5, A6, and A7 belong to the same class, and primary radiators 1 labeled B1, B2, B3, and B4 belong to the same class.

Primary radiators 1 labeled C1, C2, C3, and C4 belong to the same class, and primary radiators 1 labeled D1, D2, D3, and D4 belong to the same class.

A plurality of primary radiators 1 belonging to the same class is arranged at positions corresponding to vertexes of each of triangles in a repeated triangle pattern in which one or more triangular shapes are repeated.

Looking at the four primary radiators 1 labeled C1, C2, C3, and C4 for example, the three primary radiators 1 labeled C1, C2, and C3 are arranged in a triangular shape, and the three primary radiators 1 labeled C2, C3, and C4 are also arranged in a triangular shape.

That is, the four primary radiators 1 labeled C1, C2, C3, and C4 are arranged at positions corresponding to vertexes of each of triangles in a repeated triangle pattern $TR_{Pattern}$ in which a triangular shape $TR_{P1}$ and a triangular shape $TR_{P2}$ are arranged.

The triangular shape $TR_{P1}$ is an arrangement of the three primary radiators 1 labeled C1, C2, and C3, and the triangular shape $TR_{P2}$ is an arrangement of the three primary radiators 1 labeled C2, C3, and C4. FIG. 11 illustrates an example in which each of the triangles is an equilateral triangle.

In FIG. 11, an example of the repeated triangle pattern $TR_{Pattern}$ in which the two triangular shapes $TR_{P1}$ and $TR_{P2}$ are arranged in the horizontal direction in the figure is illustrated; however, a repeated triangle pattern $TR_{Pattern}$ in which three or more triangular shapes $TR_P$ are arranged in the horizontal direction or a repeated triangle pattern $TR_{Pattern}$ in which a plurality of triangular shapes $TR_P$ are arranged in the vertical direction may be employed.

Next, operations will be described.

The nineteen primary radiators 1 radiate beams toward the main reflector 5.

The main reflector 5 reflects the beams radiated from the nineteenth primary radiators 1.

Figure 12:
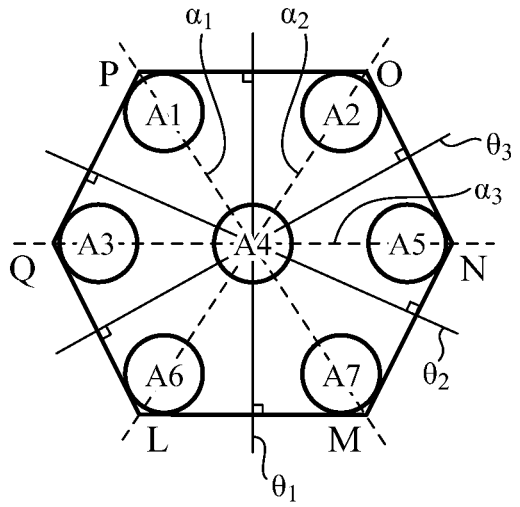
FIG. 12 is an explanatory diagram illustrating radiation directions $\theta_1$, $\theta_2$, and $\theta_3$ of sidelobes of a reflected beam of a primary radiator 1 labeled A4.

FIG. 12 is an explanatory diagram illustrating radiation directions $\theta_1$, $\theta_2$, and $\theta_3$ of sidelobes of a reflection beam of the primary radiator 1 labeled A4.

The radiation directions $\theta_1$, $\theta_2$, and $\theta_3$ of the sidelobes are determined by the aperture shape 6 of the main reflector 5, and in the case where the aperture shape of the main reflector 5 is a regular hexagon, the sidelobes are formed in directions each perpendicular to two sides of the regular hexagon opposing each other.

That is, sidelobes are formed in the direction $\theta_1$ perpendicular to both a line segment LM and a line segment OP of the regular hexagon, sidelobes are formed in the direction $\theta_2$ perpendicular to both a line segment MN and a line segment PQ of the regular hexagon, and sidelobes are formed in the direction $\theta_3$ perpendicular to both a line segment NO and a line segment QL of the regular hexagon.

Looking at the primary radiator 1 labeled A4 for example, primary radiators 1 having the same combination of frequency and polarization as that of a beam of the primary radiator 1 labeled A4 are the primary radiators 1 labeled A1, A2, A3, A5, A6, and A7.

Thus, out of beams reflected by the main reflector 5, reflection beams of the primary radiators 1 labeled A1, A2, A3, A5, A6, and A7 may be interfered by a reflection beam of the primary radiator 1 labeled A4.

However, in Second Embodiment, since the overall arrangement of the nineteen primary radiators 1 has the same regular hexagon shape as that of the aperture shape 6 of the main reflector 5, the reflection beams of the primary radiators 1 labeled A1, A2, A3, A5, A6, and A7 are not interfered by the reflection beam of the primary radiator 1 labeled A4.

That is, the primary radiator 1 labeled A4 is arranged at a position corresponding to a vertex of the same equilateral triangle as that of the primary radiators 1 labeled A1 and A2, for example. Furthermore, the primary radiator 1 labeled A4 is arranged at a position corresponding to a vertex of the same equilateral triangle as that of the primary radiators 1 labeled A1 and A3.

Directions of line segments passing through a base point of the position corresponding to the vertex of the equilateral triangles, in which the primary radiator 1 labeled A4 is arranged, and the positions corresponding to the other vertexes of the equilateral triangles are given as a direction $\alpha_1$, a direction $\alpha_2$, and a direction $\alpha_3$ as illustrated in FIG. 12.

Specifically, a direction of a line segment passing through the arrangement position of the primary radiator 1 labeled A4 and the arrangement positions of the primary radiators 1 labeled A1 and A7 is $\alpha_1$, and a direction of a line segment passing through the arrangement position of the primary radiator 1 labeled A4 and the arrangement positions of the primary radiators 1 labeled A2 and A6 is $\alpha_2$. Moreover, a direction of a line segment passing through the arrangement position of the primary radiator 1 labeled A4 and the arrangement positions of the primary radiators 1 labeled A3 and A5 is $\alpha_3$.

Because the directions $\alpha_1$, $\alpha_2$, and $\alpha_3$ of the line segments are different from the radiation directions $\theta_1$, $\theta_2$, and $\theta_3$ of the sidelobes, reflection beams of the primary radiators 1 labeled A1, A2, A3, A5, A6, and A7 are not interfered by the reflection beam of the primary radiator 1 labeled A4.

As is apparent from the above, according to Second Embodiment, the plurality of primary radiators 1 is classified by combination of frequency and polarization of the radiated radio waves, a plurality of primary radiators belonging to the same class is arranged at positions corresponding to vertexes of one of triangles in a repeated triangle pattern $TR_{Pattern}$ and the shape of the main reflector 5 and the shape and arrangement of the repeated triangle pattern $TR_{Pattern}$ are determined such that a direction of a line segment passing through positions corresponding to two vertexes in the triangle is different from a radiation direction of a sidelobe of a radio wave reflected by the main reflector 5 after having been radiated from a primary radiator 1 arranged at a position corresponding to the vertexes. Therefore, the effect of suppressing interference among all the beams having the same combination of frequency and polarization can be obtained.

Furthermore, according to Second Embodiment, the aperture shape 6 of the main reflector 5 is a regular hexagon, and one or more triangular shapes are repeated such that the repeated triangle pattern $TR_{Pattern}$ has the same shape as that of the aperture shape 6 of the main reflector 5, and thus a major part of radio waves radiated from the plurality of primary radiators 1 is reflected by the main reflector 5, thereby enabling mitigation of radio waves not reflected by the main reflector 5. Therefore, the utilization rate of radio waves is increased, and the gain of the antenna apparatus can be increased. In addition, mountability to a satellite can be enhanced for example compared to First Embodiment.

In Second Embodiment, the example has been illustrated in which interior angles of the hexagon which is the aperture shape 6 of the main reflector 5 are 120 degrees; however, even in the case where the interior angles deviate from 120 degrees by about 20%, interference among all the beams having the same combination of frequency and polarization can be suppressed. That is, even in the case where the aperture shape 6 of the main reflector 5 is not a perfect regular hexagon, interference among all the beams having the same combination of frequency and polarization can be suppressed.

In Second Embodiment, the example in which the three primary radiators 1 are arranged in a triangular shape has been illustrated; however depending on a required service area, one or two primary radiators 1 may be thinned out from those in a triangular shape $TR_P$ from among a plurality of triangular shapes $TR_P$.

Furthermore, it is only required that an arrangement of the repeated triangle pattern $TR_{Pattern}$ is in conformity with the arrangement of FIG. 11 for example, and the shape of the repeated triangle pattern $TR_{Pattern}$ is not required to be a regular hexagon as a result of thinning out some of the primary radiators 1.

In Second Embodiment, the example in which there are four combinations of frequency and polarization has been illustrated; however, this is merely an example, and the number of combinations of frequency and polarization may be three or seven, for example.

In Second Embodiment, the aperture shape 6 of the main reflector 5 is a regular hexagon; however, vertexes of the regular hexagon are not required to be angular and may be, for example, rounded or chamfered.

Third Embodiment

In First Embodiment, the aperture shape 3 of the main reflector 2 is a parallelogram. In Third Embodiment, an example in which an aperture shape of the main reflector is triangular will be described.

Figure 13:
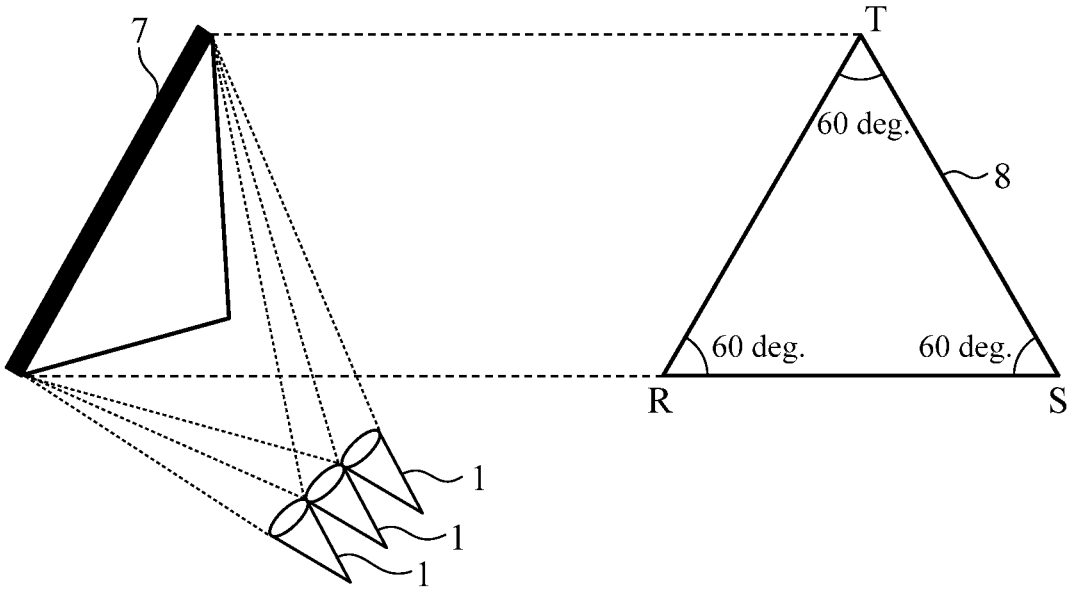
FIG. 13 is a configuration diagram illustrating an antenna apparatus according to Third Embodiment of the present disclosure.

FIG. 13 is a configuration diagram illustrating an antenna apparatus according to Third Embodiment of the present invention. In FIG. 13, the same reference numeral as that in FIG. 1 represents the same or a corresponding part and thus descriptions thereon are omitted.

A main reflector 7 is a reflector which reflects radio waves radiated from a plurality of primary radiators 1.

Reference numeral 8 denotes an aperture shape of the main reflector 7 when viewed from the front, and in the example of FIG. 13, the aperture shape 8 of the main reflector 7 is triangular.

In Third Embodiment, it is assumed that the aperture shape 8 of the main reflector 7 is an equilateral triangle.

Figure 14:
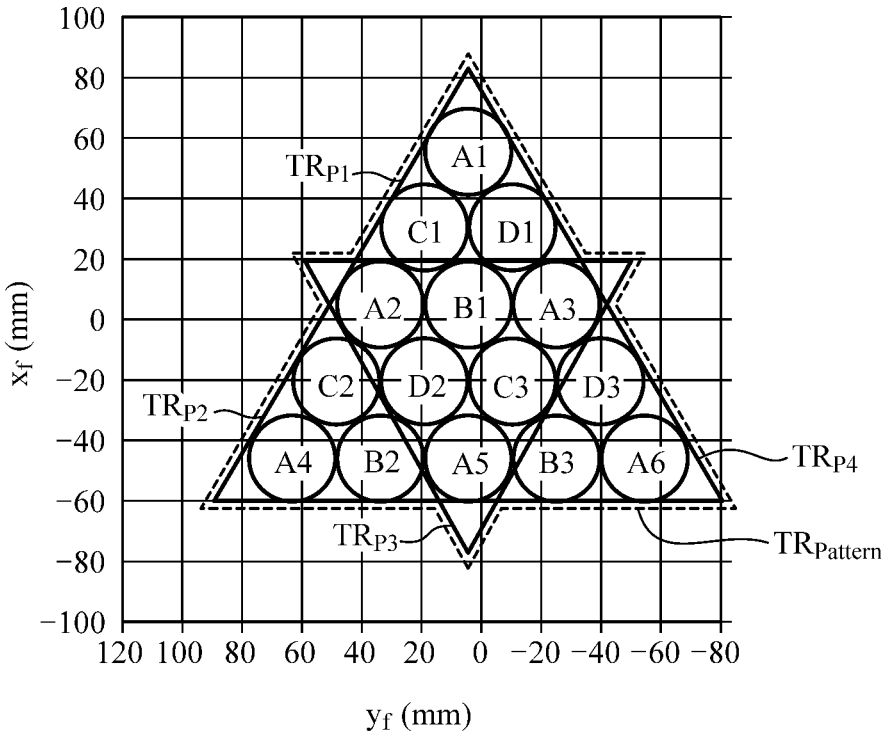
FIG. 14 is a diagram showing an illustrative example of arrangement of primary radiators 1 of the antenna apparatus according to Third Embodiment of the present disclosure.

FIG. 14 is a diagram showing an illustrative example of arrangement of the primary radiators 1 of the antenna apparatus according to Third Embodiment of the present disclosure.

FIG. 14 illustrates arrangement of the primary radiators 1 as viewed from the front, and in the example of FIG. 14 fifteen primary radiators 1 are arranged. However, this is merely an example, and the number is not limited to fifteen.

An alphabet in the figure is a label representing a combination of frequency and polarization of a radio wave radiated from a primary radiator 1, and primary radiators 1 labeled by the same alphabet use the same combination of frequency and polarization.

The fifteen primary radiators 1 in FIG. 14 are classified by combination of frequency and polarization of radiated radio waves, and primary radiators 1 labeled A1, A2, A3, A4, A5, and A6 belong to the same class, and primary radiators 1 labeled B1, B2, and B3 belong to the same class.

Primary radiators 1 labeled C1, C2, and C3 belong to the same class, and primary radiators 1 labeled D1, D2, and D3 belong to the same class.

A plurality of primary radiators 1 belonging to the same class is arranged at positions corresponding to vertexes of each of triangles in a repeated triangle pattern in which one or more triangular shapes are repeated.

Looking at the six primary radiators 1 labeled A1, A2, A3, A4, A5, and A6 for example, the three primary radiators 1 labeled A1, A2, and A3 are arranged in a triangular shape, and the three primary radiators 1 labeled A2, A4, and A5 are also arranged in a triangular shape. The three primary radiators 1 labeled A2, A3, and A5 are arranged in a triangular shape, and the three primary radiators 1 labeled A3, A5, and A6 are arranged in a triangular shape.

That is, the six primary radiators labeled A1, A2, A3, A4, A5, and A6 are arranged at positions corresponding to vertexes of each of triangles in a repeated triangle pattern $TR_{Pattern}$ in which a triangular shape $TR_{P1}$, a triangular shape $TR_{P2}$, a triangular shape $TR_{P3}$, and a triangular shape $TR_{P4}$ are arranged.

The triangular shape $TR_{P1}$ is an arrangement of the three primary radiators 1 labeled A1, A2, and A3, the triangular shape $TR_{P2}$ is an arrangement of the three primary radiators 1 labeled A2, A4, and A5, the triangular shape $TR_{P3}$ is an arrangement of the three primary radiators 1 labeled A2, A3, and A5, and the triangular shape $TR_{P4}$ is an arrangement of the three primary radiators 1 labeled A3, A5, and A6. FIG. 14 illustrates an example in which each of the triangles is an equilateral triangle.

In FIG. 14, an example of the repeated triangle pattern $TR_{Pattern}$ in which the three triangular shapes $TR_{P2}$, $TR_{P3}$, and $TR_{P4}$ are arranged in the horizontal direction in the figure and the triangular shapes $TR_{P1}$, $TR_{P2}$, $TR_{P3}$, and $TR_4$ are arranged in the vertical direction in the figure is illustrated; however, the present invention is not limited thereto, and the number of repetitive patterns in the horizontal direction and the vertical direction may be any number.

Next, operations will be described.

The fifteen primary radiators 1 radiate beams toward the main reflector 7.

The main reflector 7 reflects the beams radiated from the fifteenth primary radiators 1.

Figure 15:
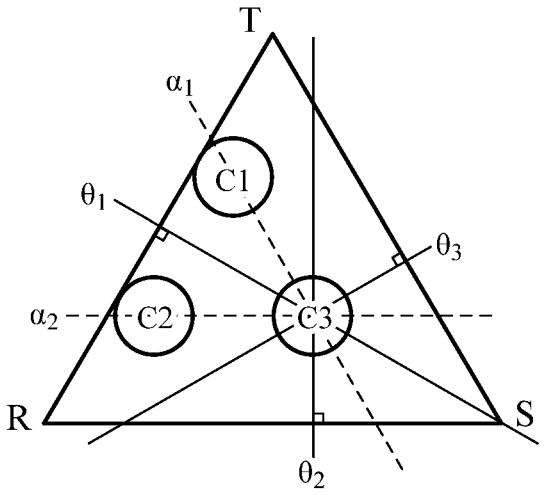
FIG. 15 is an explanatory diagram illustrating radiation directions $\theta_1$, $\theta_2$, and $\theta_3$ of sidelobes of a reflected beam of a primary radiator 1 labeled C3.

FIG. 15 is an explanatory diagram illustrating radiation directions $\theta_1$, $\theta_2$, and $\theta_3$ of sidelobes of a reflection beam of the primary radiator 1 labeled C3.

The radiation directions $\theta_1$, $\theta_2$, and $\theta_3$ of the sidelobes are determined by the aperture shape 8 of the main reflector 7, and in the case where the aperture shape 8 of the main reflector 7 is an equilateral triangle, the sidelobes are formed in directions each perpendicular to one side of the equilateral triangle.

That is, sidelobes are formed in the direction $\theta_1$ perpendicular to a line segment TR of the equilateral triangle, sidelobes are formed in the direction $\theta_2$ perpendicular to a line segment RS of the equilateral triangle, and sidelobes are formed in the direction $\theta_3$ perpendicular to a line segment ST of the equilateral triangle.

Looking at the primary radiator 1 labeled C3 for example, primary radiators 1 having the same combination of frequency and polarization as that of a reflection beam of the primary radiator 1 labeled C3 are the primary radiators 1 labeled C1 and C2.

Thus, out of beams reflected by the main reflector 7, reflection beams of the primary radiators 1 labeled C1 and C2 may be interfered by a reflection beam of the primary radiator 1 labeled C3.

However, in Third Embodiment, because the overall arrangement of the fifteen primary radiators 1 has the same equilateral triangle shape as that of the aperture shape 8 of the main reflector 7, the reflection beams of the primary radiators 1 labeled C1 and C2 are not interfered by the reflection beam of the primary radiator 1 labeled C3.

That is, the primary radiator 1 labeled C3 is arranged at a position corresponding to a vertex of the same equilateral triangle as that of the primary radiators 1 labeled C1 and C2.

Directions of line segments passing through a base point of the position corresponding to the vertex of the equilateral triangle, in which the primary radiator 1 labeled C3 is arranged, and the positions corresponding to the other vertexes of the equilateral triangle are given as a direction $\alpha_1$ and a direction $\alpha_2$ as illustrated in FIG. 15.

Specifically, a direction of a line segment passing through the arrangement position of the primary radiator 1 labeled C3 and the arrangement position of the primary radiator 1 labeled C1 is $\alpha_1$, and a direction of a line segment passing through the arrangement position of the primary radiator 1 labeled C3 and the arrangement position of the primary radiator 1 labeled C2 is $\alpha_2$.

Here, because the directions $\alpha_1$ and $\alpha_2$ of the line segments are different from the radiation directions $\theta_1$, $\theta_2$, and $\theta_3$ of the sidelobes, the reflection beams of the primary radiators 1 labeled C1 and C2 are not interfered by the reflection beam of the primary radiator 1 labeled C3.

As is apparent from the above, according to Third Embodiment, the plurality of primary radiators 1 is classified by combinations of frequency and polarization of the radiated radio waves, a plurality of primary radiators belonging to the same class is arranged at positions corresponding to vertexes of one of triangles in a repeated triangle pattern $TR_{Pattern}$, and the shape of the main reflector 7 and the shape and arrangement of the repeated triangle pattern $TR_{Pattern}$ are determined such that a direction of a line segment passing through positions corresponding to two vertexes in the triangle is different from a radiation direction of a sidelobe of a radio wave reflected by the main reflector 7 after having been radiated from a primary radiator 1 arranged at a position corresponding to the vertexes. Therefore, the effect of suppressing interference among all the beams having the same combination of frequency and polarization can be obtained.

Furthermore, according to Third Embodiment, the aperture shape 8 of the main reflector 7 is a equilateral triangle, and one or more triangular shapes are repeated such that the repeated triangle pattern $TR_{Pattern}$ has the same shape as that of the aperture shape 8 of the main reflector 7, and thus a major part of radio waves radiated from the plurality of primary radiators 1 is reflected by the main reflector 7, thereby enabling mitigation of radio waves not reflected by the main reflector 7. Therefore, the utilization rate of radio waves is increased, and the gain of the antenna apparatus can be increased.

In Third Embodiment, the example has been illustrated in which interior angles of the triangle which is the aperture shape 8 of the main reflector 7 are 60 degrees; however, even in the case where the interior angles deviate from 60 degrees by about 20%, interference among all the beams having the same combination of frequency and polarization can be suppressed. That is, even in the case where the aperture shape 8 of the main reflector 7 is not a perfect equilateral triangle, interference among all the beams having the same combination of frequency and polarization can be suppressed.

In Third Embodiment, the example in which the three primary radiators 1 are arranged in a triangular shape has been illustrated; however depending on a required service area, one or two primary radiators 1 may be thinned out from those in a triangular shape $TR_P$ from among a plurality of triangular shapes $TR_P$.

Furthermore, it is only required that an arrangement of the repeated triangle pattern $TR_{Pattern}$ is in conformity with the arrangement of FIG. 14 for example, and the shape of the repeated triangle pattern $TR_{Pattern}$ is not required to be a equilateral triangle as a result of thinning out some of the primary radiators 1.

In Third Embodiment, the example in which there are four combinations of frequency and polarization has been illustrated; however, this is merely an example, and the number of combinations of frequency and polarization may be three or seven, for example.

In Third Embodiment, the aperture shape 8 of the main reflector 7 is an equilateral triangle; however, vertexes of the equilateral triangle are not required to be angular and may be, for example, rounded or chamfered.

Fourth Embodiment

In First to Third Embodiments, each of the primary radiators 1 radiates one beam to the main reflectors 2, 5, and 7; however, a plurality of radiating elements may radiate one beam to the main reflector 2, 5, or 7.

Figure 16:
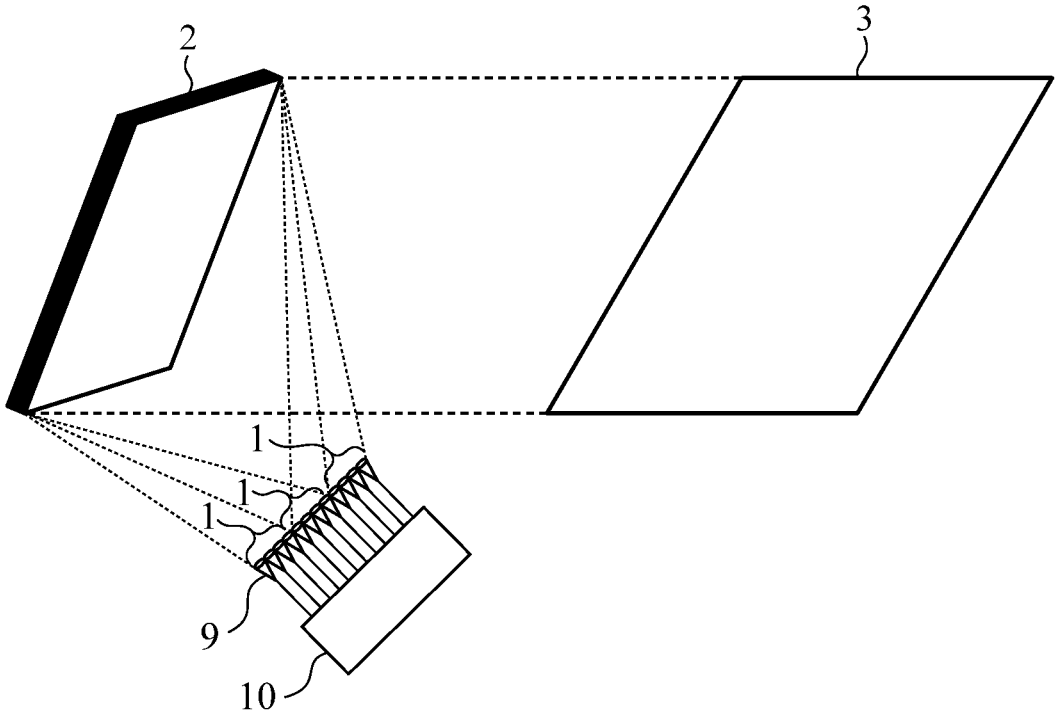
FIG. 16 is a configuration diagram illustrating an antenna apparatus according to Fourth Embodiment of the present disclosure.

FIG. 16 is a configuration diagram illustrating an antenna apparatus according to a fourth embodiment of the present disclosure. In FIG. 16, the same reference numeral as that in FIG. 1 represents the same or a corresponding part and thus descriptions thereon are omitted.

Each of primary radiators 1 includes a plurality of radiating elements 9.

In the antenna apparatus of FIG. 16, for simplicity of explanation, an example in which three primary radiators are mounted is illustrated. However, in practice, a plurality of primary radiators 1 for radiating radio waves having the same combination of frequency and polarization is mounted, and a plurality of primary radiators 1 for radiating radio waves having different combinations of frequency and polarization is also mounted. Thus, also in the antenna apparatus of FIG. 16, sixteen primary radiators 1 are mounted for example like the antenna apparatus of FIG. 1 according to First Embodiment.

However, the number of primary radiators 1 and the number of radiating elements included in each of the primary radiators 1 may be any number.

A beam forming circuit 10 is a feeding circuit for exciting a plurality of radiating elements 9 in the primary radiators 1.

The beam forming circuit 10 excites four radiating elements 9 such that radio waves having the same combination of frequency and polarization are radiated from the four radiating elements 9 belonging to the same primary radiator 1 while exciting each group of four radiating elements 9 belonging to the three primary radiators 1 such that combinations of frequency and the polarization of radio waves radiated from the three primary radiators 1 are different.

In the beam forming circuit 10, an excitation coefficient is designed for each of the radiating elements 9, and in the case where the direction of beams radiated from the three primary radiators 1 are fixed, a signal capable of implementing the excitation coefficient is fed to the radiating element 9.

In the case where the direction of beams radiated from the three primary radiators 1 is variable, the beam forming circuit 10 includes phase shifters for adjusting the phase of a signal output to each of the plurality of radiating elements 9 and a variable gain amplifier(s) for adjusting the amplitude of a signal output to the plurality of radiating elements 9, to adjust excitation coefficients of the radiating elements 9 with the phase shifters and the variable gain amplifier(s).

As a result, the radiation direction of a beam reflected by the main reflector 2, a range of a service area of the beam, and the like can be variable.

As is clear from the above, according to Fourth Embodiment, since the beam forming circuit 10 for exciting the plurality of radiating elements 9 is included, the effect of suppressing interference among all the beams having the same combination of frequency and polarization can be obtained like in First Embodiment described above as well as the effect of enhancing the degree of freedom of the radiation direction or other features of the beam.

In Fourth Embodiment, the plurality of radiating elements 9 and the beam forming circuit 10 are used for the antenna apparatus of First Embodiment in which the aperture shape 3 of the main reflector 2 is a parallelogram; however, the plurality of radiating elements and the beam forming circuit 10 may be used for the antenna apparatus in which the aperture shape 6 of the main reflector 5 is a regular hexagon as in Second Embodiment or the antenna apparatus in which the aperture shape 8 of the main reflector 7 is an equilateral triangle as in Third Embodiment.

Fifth Embodiment

In First to Fourth Embodiments, the plurality of primary radiators 1 radiate beams to the main reflectors 2, 5, and 7; however, the beams radiated from the plurality of primary radiators 1 may be radiated toward the main reflector 2, 5, or 7 via a secondary reflector.

Figure 17:
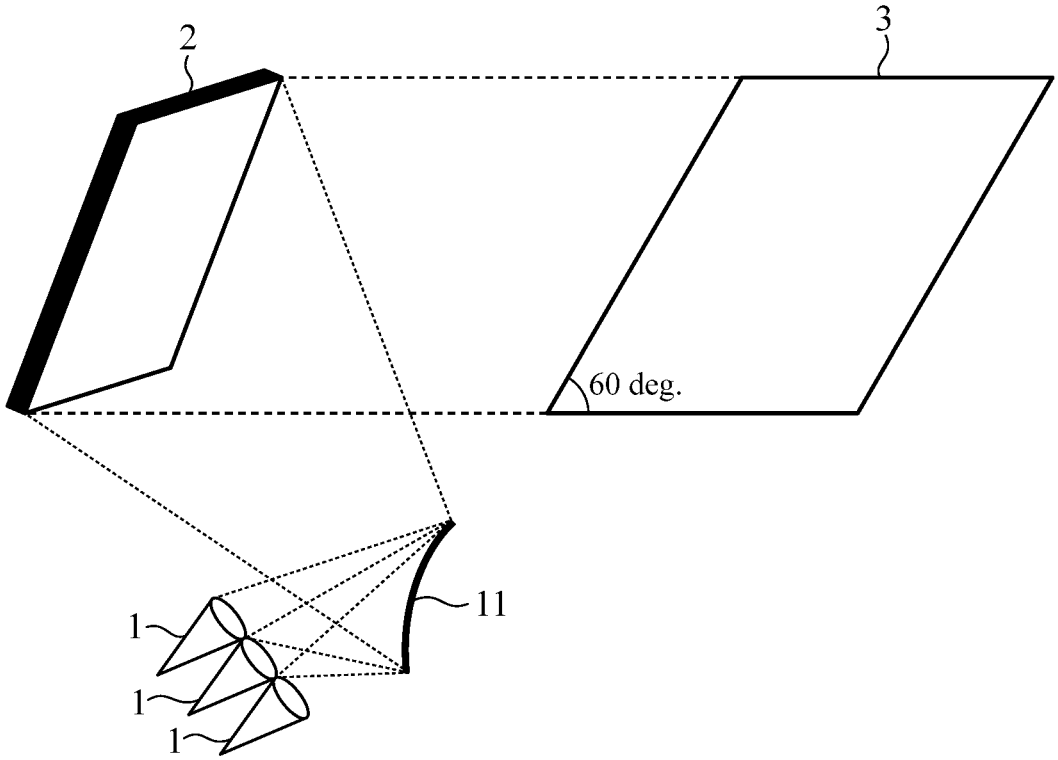
FIG. 17 is a configuration diagram illustrating an antenna apparatus according to Fifth Embodiment of the present disclosure.

FIG. 17 is a configuration diagram illustrating an antenna apparatus according to Fifth Embodiment of the present disclosure. In FIG. 17, the same reference numeral as that in FIG. 1 represents the same or a corresponding part and thus descriptions thereon are omitted.

A secondary reflector 11 is a reflector which reflects radio waves radiated from a plurality of primary radiators 1 toward a main reflector 2, and in the example of FIG. 17, the secondary reflector 11 is a Cassegrain type reflector having a mirror surface of a hyperboloid of revolution.

Even in the case where the secondary reflector 11 reflects the beams radiated from the plurality of primary radiators 1 toward the main reflector 2, interference among all the beams having the same combination of frequency and polarization can be suppressed like in First Embodiment described above.

Here, the secondary reflector 11 of a Cassegrain type having a mirror surface of a hyperboloid of revolution is described as an example; however, a secondary reflector 11 of a Gregorian type having a mirror surface of an ellipsoid of revolution may be used. Alternatively, a secondary reflector 11 having a flat mirror surface may be used.

Moreover, the secondary reflector 11 may include a plurality of reflectors.

In Fifth Embodiment, the secondary reflector 11 is used for the antenna apparatus of First Embodiment; however, the secondary reflector 11 may be used for the antenna apparatuses of Second to Fourth Embodiments described above.

Note that, within the scope of the present invention, Embodiments may be combined freely, modifications may be made to any component of Embodiments, or omission of any component in Embodiments may be made.

INDUSTRIAL APPLICABILITY

Antenna apparatuses disclosed in the present disclosure is suitable for antenna apparatuses with high gain and low interference.

REFERENCE SIGNS LIST

1: Primary radiator, 2: Main reflector, 3: Aperture shape of the main reflector, 4: Radiation direction of beam, 5: Main reflector, 6: Aperture shape of main reflector, 7: Main reflector, 8: Aperture shape of main reflector, 9: Radiating element, 10: Beam forming circuit, 11: Secondary reflector.

The invention claimed is:

1. An antenna apparatus comprising:

a plurality of primary radiators for radiating radio waves; and a main reflector for reflecting the radio waves radiated from the plurality of primary radiators, wherein the plurality of primary radiators is subdivided into a plurality of classes by combination of frequency and polarization of the radiated radio waves, each class comprising at least three primary radiators radiating radio waves having the same combination of frequency and polarization, the main reflector reflects the radio waves radiated from the Plurality of classes, the radio waves reflected by the main reflector having a main lobe and sidelobes, a direction of the sidelobes being defined with respect to the main lobe as a feature based on a shape of the main reflector, a plurality of primary radiators belonging to a same class is arranged, in a repeated triangle pattern in which a triangle is arranged repeatedly, at positions corresponding to vertexes of each triangle, and the shape of the main reflector and a shape and arrangement of the repeated triangle pattern are determined such that a direction of a line segment passing through positions corresponding to two vertexes of each triangle in the repeated triangle pattern is different from the direction of the sidelobes.

2. The antenna apparatus according to claim 1, wherein an aperture shape of the main reflector is a parallelogram, and the repeated triangle pattern includes one or more triangles so as to form a same shape as the aperture shape.

3. The antenna apparatus according to claim 1, wherein an aperture shape of the main reflector is a hexagon, and the repeated triangle pattern includes one or more triangles so as to form a same shape as the aperture shape.

4. The antenna apparatus according to claim 1, wherein an aperture shape of the main reflector is a triangle, and the repeated triangle pattern includes one or more triangles so as to form a same shape as the aperture shape.

5. The antenna apparatus according to claim 1, wherein each of the plurality of primary radiators includes a plurality of radiating elements, and the antenna apparatus further comprises a beam forming circuit for exciting the plurality of radiating elements.

6. The antenna apparatus according to claim 1, further comprising a secondary reflector for reflecting the radio waves radiated from the plurality of primary radiators toward the main reflector.

* * * * *